US006857801B2

(12) United States Patent
Van Bever

(10) Patent No.: US 6,857,801 B2
(45) Date of Patent: Feb. 22, 2005

(54) LABEL PRINTER

(75) Inventor: Mario Van Bever, Evergem (BE)

(73) Assignee: Esselte, Sint-Niklaas (BE)

( * ) Notice: Subject to any disclaimer, the term of this patent is extended or adjusted under 35 U.S.C. 154(b) by 0 days.

(21) Appl. No.: 10/455,619

(22) Filed: Jun. 6, 2003

(65) Prior Publication Data

US 2004/0033099 A1 Feb. 19, 2004

(30) Foreign Application Priority Data

Jun. 7, 2002 (GB) ..... 0213115

(51) Int. Cl.[7] ..... B41J 11/42; G09F 3/06

(52) U.S. Cl. ..... 400/615.2; 400/62; 400/621; 40/316

(58) Field of Search ..... 400/62, 70, 76, 400/615.2, 621; 40/316

(56) References Cited

U.S. PATENT DOCUMENTS 4,578,136 A 3/1986 Brown ..... 156/249
4,609,208 A * 9/1986 Wrobel ..... 283/81
5,344,247 A * 9/1994 Sakuragi et al. ..... 400/582
5,374,130 A 12/1994 Hirono ..... 400/68
5,931,587 A * 8/1999 Hayama ..... 400/76
6,129,796 A * 10/2000 Steinberg et al. ..... 156/64
6,371,670 B1 * 4/2002 Kojo ..... 400/120.01
2002/0154933 A1 * 10/2002 Kalette ..... 400/615.2

FOREIGN PATENT DOCUMENTS

JP 2000 098903 4/2000

* cited by examiner

*Primary Examiner*—Stephen R. Funk
(74) *Attorney, Agent, or Firm*—Morgan, Lewis & Bockius LLP

(57) ABSTRACT

A label for applying to a support in a flag-type mode and a tape printer for printing the label to provide the correct size of printed and unprinted areas is described, wherein the label has a first area and a second area adjacent to the first area. The first area and the second area are arranged in use to provide a flag portion. The label further comprises a third area arranged on the other side of the second area to the first layer. The third area is sized to be wound around a periphery of the support.

16 Claims, 6 Drawing Sheets

LABEL PRINTER

FIELD OF THE INVENTION

The present invention relates to a label printer or tape printing device for printing an image on a tape to print the label, where the label or tape is adapted for applying to a support and has a flag area, a label area, and an area sized to fit around the support.

BACKGROUND OF THE INVENTION

Known tape printing apparatus of the type which can be modified to the present invention are disclosed in for example EP-A-322918 and EP-A-322919 (Brother Kogyo Kabushiki Kaisha) and EP-A-267890 (Varitronic). The printers each include a printing device having a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double sided adhesive tape which is secured at one of its adhesive coated sides to the image tape after printing and which has a backing layer peelable from its other adhesive coated side. With both these apparatus, the image transfer medium (ink ribbon) and the image receiving tape (substrate) are in the same cassette.

It has also been proposed by the present applicants in, for example, EP-A-578372 to house the ink ribbon and the substrate tape in separate cassettes.

In all of these cases, the image receiving tape passes in overlap with the ink ribbon to a print zone consisting of a fixed print head and a platen (or vice versa) against which the print head can be pressed to cause an image to transfer from the ink ribbon to the image receiving tape. There are many ways of doing this, including dry lettering or dry film impression, but the most usual way currently is by thermal transfer printing where the print head is heated and the heat causes ink from the ink ribbon to be transferred to the image receiving tape.

U.S. Pat. No. 5,374,130 describes a tape printer for generating labels to be applied to a cord. The document describes the production of a label having a first area in which text is printed. This area is next to an area which is to be wound around the cord. A second area for text is located on the other side of the area which is to be wound around the cord. The two areas containing text are stuck together to form a flag. This label has the following disadvantages. Firstly the flag has to be formed as the label is applied to the cable. This can be difficult to do if the cord is in a difficult to access location. If the flag is badly formed, adhesive on the back of the label will be exposed which will attract dirt and dust which is undesirable. Secondly, the length of the winding part can cause difficulties. If the length is too short, then part of the text may actually be around the cord which makes reading difficult. Accordingly, it is necessary to build in a relatively large margin of error in the winding part of the label. This means that the flags may be larger than required which may be disadvantageous where for example there are a large number of cables in a confined space. Additionally this is wasteful of tape It is an aim of embodiments of the present invention to address one or more of the above problems.

SUMMARY OF THE INVENTION

According to a first aspect of the present invention there is provided a label for applying to a support, said label having a first area and a second area adjacent to said first area, said first area and said second layer are arranged in use to provide a flag portion, said label further comprising a third area arranged on the other side of said second area to the first layer, said third area being sized or sizable to be wound around a periphery of said support.

Preferably at least one of said first and second areas is arranged to contain text. The first and second areas can be arranged to contain the same text.

In one embodiment, the label has a first layer and an adhesive layer applied thereto. Thus text can be applied to one side of said first layer and said adhesive layer can be applied to another side of said first layer.

In some embodiments the label may have a plurality of layers, wherein at least one of said first and second layerss is adapted to contain text. The first and second layers can be arranged to contain the same text.

The invention also encompasses a tape printer adapted for printing such a label as described in any of the embodiments.

According to a second aspect of the present invention, there is provided a tape printer for printing a label on a length of tape, said tape printer comprising: means for receiving a supply of tape; means for printing an image on said tape; means for receiving image data for printing on said tape, said tape printer having a flag mode for producing a label to be wound around a support, said tape printer being arranged in said flag mode to provide a label having a first area and a second area adjacent to said first area, said first area and said second area are arranged in use to provide a flag portion, said printing means being arranged to print an image on at least one of said first and second areas, said label further comprising a third area arranged on the other side of said second area to the first layer, said third area being sized to be wound around a periphery of said support.

According to a third aspect of the present invention, there is provided a tape printer for printing a label to be wound around a support, said tape printer comprising: means for receiving an image to be printed on said label and information relating to the size of said support; means for determining the length of the label based on the received information; means for receiving a supply of tape; and printing means for printing said image on said tape a plurality of times across the width of said tape.

The invention also includes embodiments encompassing various combinations of features described in the embodiments above.

BRIEF DESCRIPTION OF THE DRAWINGS

For a better understanding of the present invention and as to how the same may be carried into effect, reference will now be made by way of example only to the accompanying drawings in which.

DETAILED DESCRIPTION OF EMBODIMENTS

Figure 1:
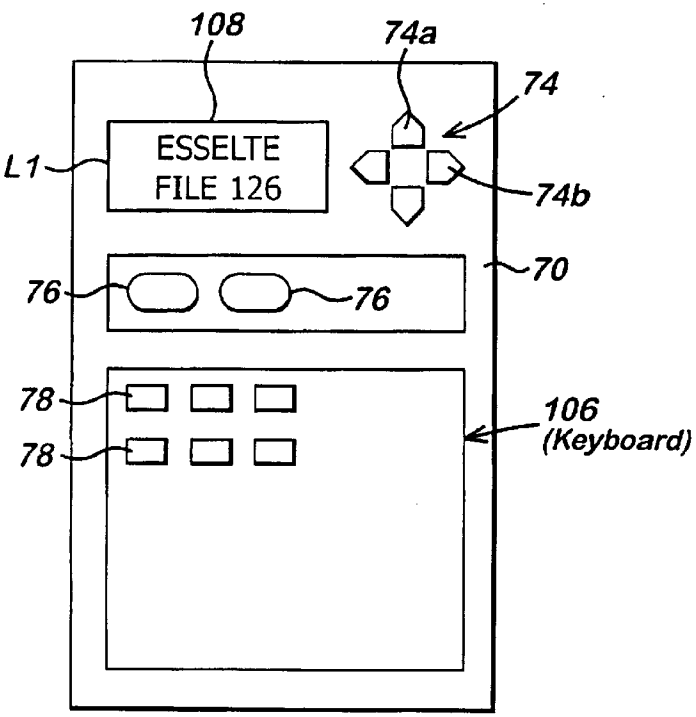
FIG. 1 is a schematic diagram of the front part of the casing of a printing device.

FIG. 1 illustrates the front of a tape printing device. Reference numeral 70 denotes the casework of the printer. The front of the printer carries a liquid crystal display (LCD) 108 and a keyboard 106 having a plurality of cursor control keys 74, e.g. 74*a*, 74*b*, a plurality of function keys 76, only two of which are illustrated in FIG. 1, and a plurality of character selecting keys 78, only six of which are illustrated in FIG. 1. The keyboard 106 is used for inputting characters to the tape printing device. This could be achieved with other input means, for example a touch pad or a touch screen. The keyboard, pad or screen need not be in physical contact with the device. The function keys include a return key, a delete key, an edit key, and a print key. In alternative embodiments of the invention additional and/or alternative functions may be provided. As is known, combinations of keys can be used in place of individual keys for each function.

The display can display two lines of text. Other embodiments may be able to display more or less than two lines of text. The display is illustrated displaying a two line label (L1) ESSELTE (first line) FILE 126 (second line). As is known, the character selecting keys 78 allow text to be selected by a user to formulate labels to be printed. The term "text" as used herein refers to numerals, symbols, icons, background patterns, barcodes, and similar, as well as characters, which together may make up an image to be printed on a label. The function keys 76 allow different functions to be implemented, and in effect control the operational modes of the printer.

The printer operates with a supply of tape on which images are printed. Lengths of the tape are cut off after a label has been printed. The tape is housed in a cassette which is held in a cassette bay.

Typically, this tape printing device 1 is a hand held or small desk top device which is powered by batteries at least part of the time. Alternatively, the tape printing device may be supplied with power from an exterior supply.

Figure 2:
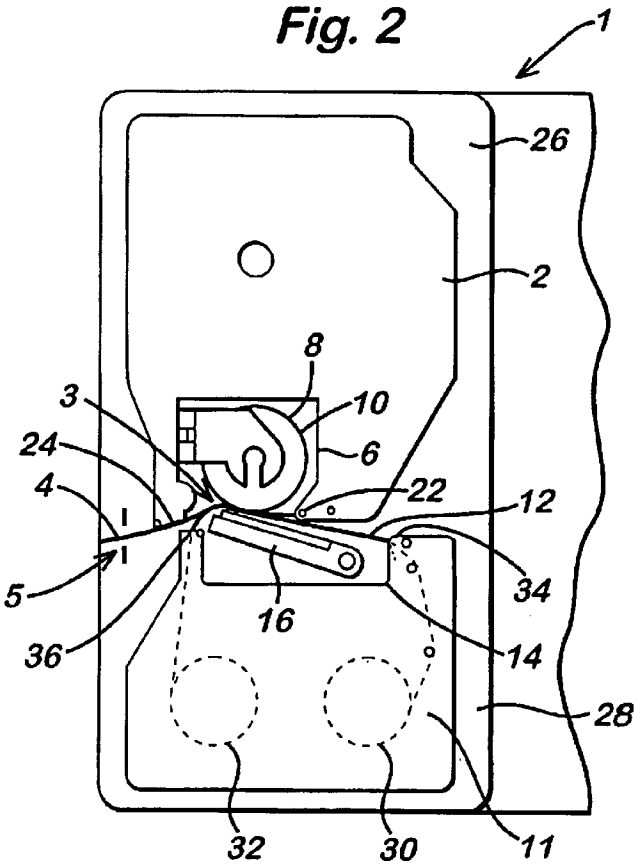
FIG. 2 is a plan view of a first tape printing device embodying the present invention using a two cassette system.

FIG. 2 shows in plan view, with the outer casing depicted in FIG. 1 removed, the first tape printing device embodying the present invention which has two cassettes arranged therein. The upper cassette 2 is located in a first cassette receiving portion 26 and contains a supply of image receiving tape 4 which passes through a print zone 3 of the tape printing device 1 to an outlet 5 of the tape printing device 1. The image receiving tape 4 comprises an upper layer for receiving a printed image on one of its surfaces and has its other surface coated with an adhesive layer to which is secured a releasable backing layer. The upper cassette 2 has a recess 6 for accommodating a platen 8 of the tape printing device 1, and guide portions 22 and 24 for guiding the tape through the print zone 3. The platen 8 is mounted for rotation within a cage moulding 10. Alternatively, the platen could be mounted for rotation on a pin.

The lower cassette 11 is located in a second cassette receiving portion 28 and contains a thermal transfer ribbon 12 which extends from a supply spool 30 to a take up spool 32 within the cassette 11. The thermal transfer ribbon 12 extends through the print zone 3 in overlap with the image receiving tape 4. The cassette 11 has a recess 14 for receiving a print head 16 of the tape printing device 1 and guide portions 34 and 36 for guiding the thermal transfer ribbon 12 through the print zone 3. The print head 16 is movable between an operative position shown in FIG. 2, in which it is in contact with the platen 8 and holds the thermal transfer ribbon 12 and the image receiving tape 4 in overlap between the print head 16 and the platen 8 and in an inoperative position in which it is moved away from the platen 8 to release the thermal transfer ribbon 12 and image receiving tape 4. In the operative position, the platen 8 is rotated to cause the image receiving tape 12 to be driven past the print head 16 and the print head 16 is controlled to print an image on the image receiving tape 4 by thermal transfer of ink from the ribbon 12.

The tape printing device 1 has a lid (which is not shown) but which is hinged along the rear of the cassette receiving portions 26 and 28 and which covers both cassettes when in place. The lid may of course be hinged to or connected to the tape printing device in any other suitable way. In alternative embodiments of the invention, the lid may not be hinged but may be attached to the tape printer; when required, in any other suitable way.

Advantageously, a dc motor 7 (see FIG. 4) continuously drives the platen 8. Alternatively, a dc motor 7 (see FIG. 4) may intermittently drive the platen 8. The platen is arranged to drive the image receiving tape 4 through the print zone 3 by the actuation of its own rotation.

The image is printed by the print head 16 on the image receiving tape on a column by column basis with the columns being adjacent one another in the direction of movement of the tape 4.

Figure 3:
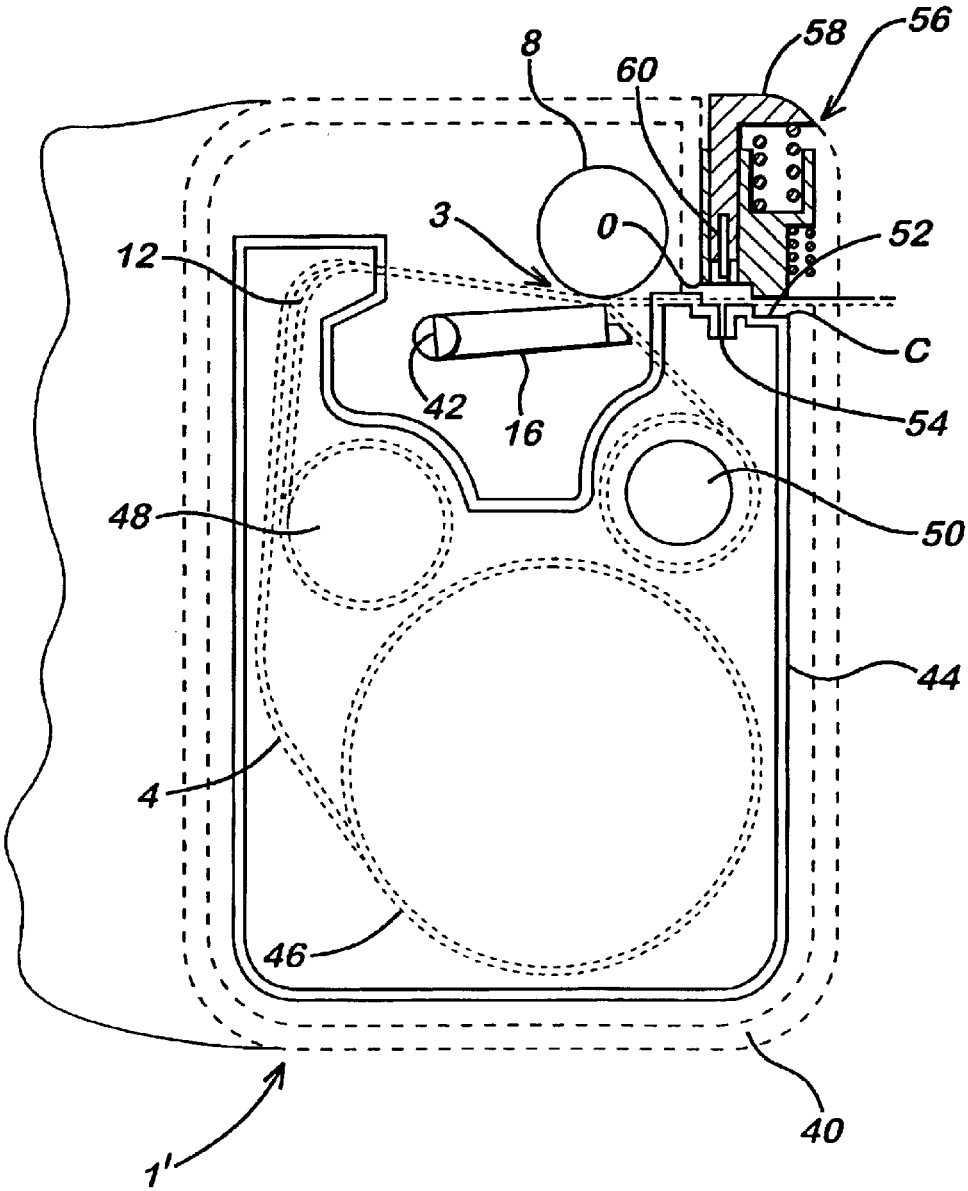
FIG. 3 is a plan view of a second tape printing device embodying the present invention, using a one cassette system.

FIG. 3 illustrates in plan view a cassette bay of a second printing device 1' embodying the present invention which uses a one cassette system. It has its outer casing as depicted in FIG. 1 removed. Like reference numerals are used for those parts which are also shown in FIG. 2. The cassette bay is shown by the dotted line 40. The cassette bay 40 includes a thermal print head 16 and a platen 8 which cooperate to define a print zone 3. The thermal print head 16 is the same as that discussed in relation to FIG. 2.

The print head 16 is pivotable about a pivot point 42 so that it can be brought into contact with the platen 8 for printing and moved away from the platen 8 to enable the cassette to be removed and replaced as in the first embodiment. A cassette inserted into the cassette bay 40 is denoted generally by reference numeral 44. The cassette 44 holds a supply spool 46 of image receiving tape 4. The image receiving tape 4 is guided by a guide mechanism (which is not shown) through the cassette 44, out of the cassette 44 through an outlet O past the print zone 3 to a cutting location C. The same cassette 44 also has an ink ribbon supply spool 48 and an ink ribbon take up spool 50. The ink ribbon 12 is guided from the ink ribbon supply spool 48 through the print zone 3 and taken up on the ink ribbon take up spool 50. As with the first embodiment, the image receiving tape 4 passes in overlap with the ink ribbon 12 through the print zone 3 with its image receiving layer in contact with the ink ribbon 12. The platen of this second embodiment is also driven by a motor 7. The motor rotates to drive the image receiving tape through the print zone 3 continuously during printing. In either of the embodiments, it is possible that the tape be driven in a step wise manner by a stepper motor.

An image is printed on the tape fed out from the print zone to the cutting location C which is provided at a location in a portion of the wall of the cassette 44 which is close to the print zone 3. The portion of the wall on the cassette 44 where the cutting location C is defined is denoted by reference 52. A slot 54 is defined in the wall portion 52 and the image receiving tape 4 is fed past the print zone 3 to the cutting location C where it is supported by facing wall portions on either side of the slot 54.

The second tape printing device 1' includes a cutting mechanism 56 including a cutter support member 58 which carries a blade 60. The blade 60 cuts the image receiving tape 4 and then enters the slot 54. It should be appreciated that the first embodiment will usually also include a cutting mechanism.

The ink ribbon can be omitted in certain embodiments where the image receiving tape is of a thermally sensitive material. In this case, the image is printed by the thermal print head directly onto the thermally sensitive image receiving tape.

Figure 4:
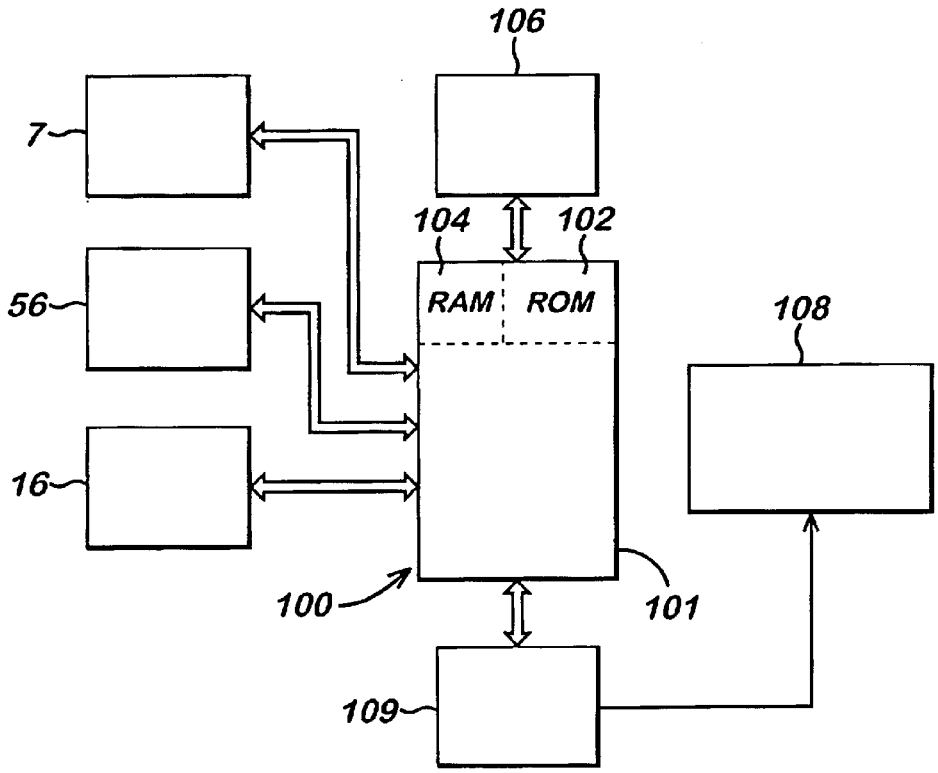
FIG. 4 is a diagrammatic sketch showing the control circuitry or steps for the printing device of FIG. 2 or of FIG. 3.

Basic circuitry for controlling the tape printing device 1 of FIG. 2 or the tape printing device 1' of FIG. 3 is shown in FIG. 4. There is a microprocessor chip 100 having a read only memory (ROM) 102, a microprocessor 101 and random access memory capacity indicated diagrammatically by RAM 104. The microprocessor chip 100 is connected to receive label data input to it from a data input device such as a keyboard 106. The microprocessor chip 100 outputs data to drive a display 108 via a display driver chip 109 to display a label to be printed (or a part thereof) and/or a message for the user. The display driver alternatively may form part of the microprocessor chip. Additionally, the microprocessor chip 100 also outputs data to drive the print head 16 so that the label data is printed onto the image receiving tape to form a label. Finally, the microprocessor chip 100 also controls the motor 7 for driving the platen. The microprocessor chip 100 may also control the cutting mechanism 56 of FIG. 3 or a cutting mechanism of FIG. 2 to allow a length of tape to be cut off. In alternative embodiments at least part of the cutting mechanism may be manually operated.

Figure 5:
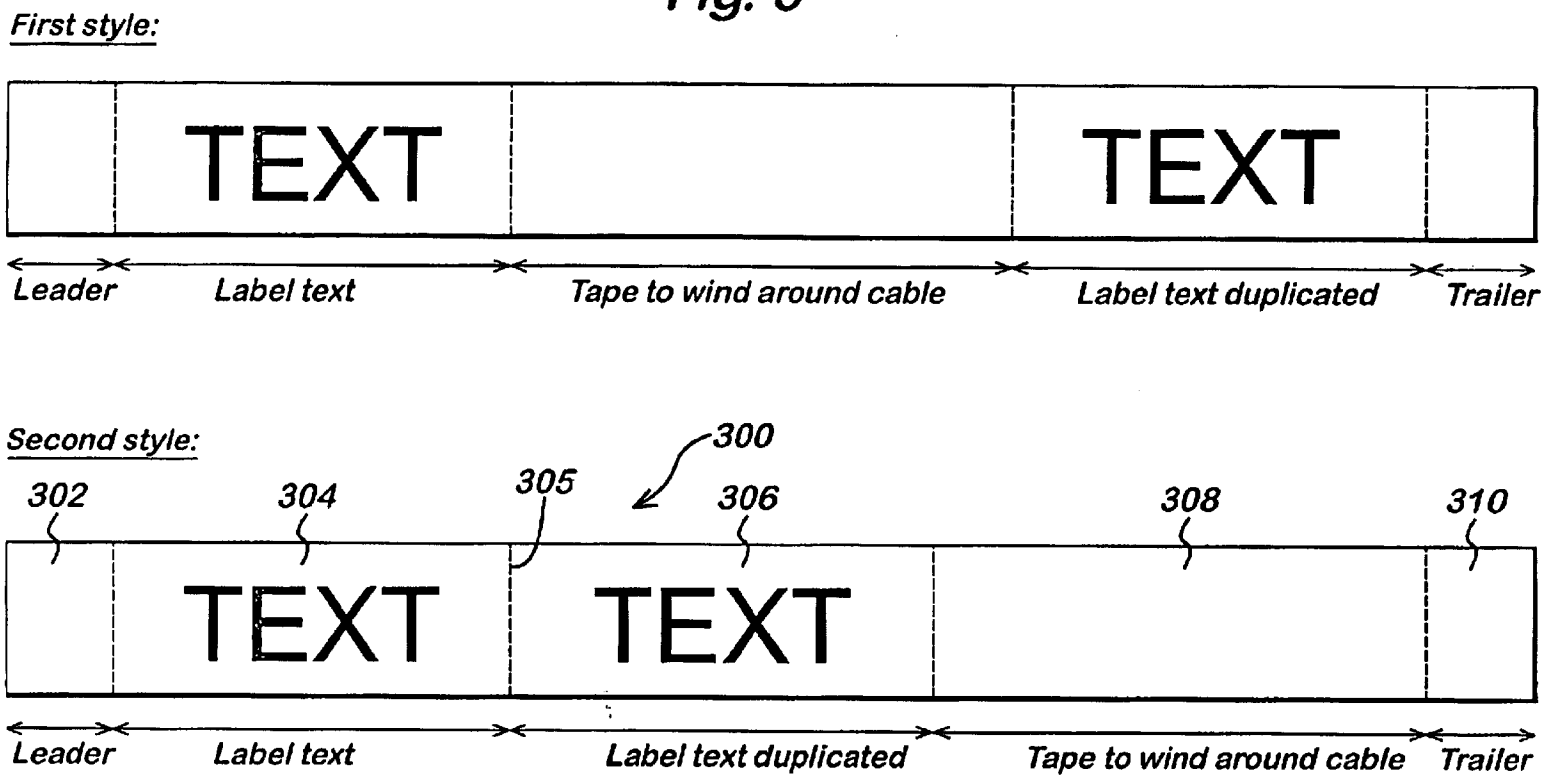
FIG. 5 shows a first label embodying the present invention.

Reference is made to FIG. 5 which shows a first label 300 which can be produced by embodiments of the present invention to provide a flagging label. The label 300 has a first margin 302 at the beginning of the label which is the leader of the label. It should be appreciated that depending on the configuration of the label printer, this can be eliminated or at least made very small. In other embodiments of the present invention the size of the leader 302 can be set by the user. The leader 302 may be automatically set by the tape printer either to have a fixed length, no length or have a length dependent on the length of the label, the width of the tape and/or the text style contained on the label.

In alternative embodiments, the tape may be printed in reverse so that the leader is effectively output by the tape printer after the trailer. In those embodiments, the length 302 can be zero.

Next to the header 302, if present, the label text is printed in area 304. This is the text that will appear on one side of the flag. The term text should be construed broadly in the context of this document and is intended to cover anything printed by the label printer on the label. The following are non limiting examples of text: characters, numbers, symbols, pictures, graphics and logos. It should be appreciated that text can contain for example more than one of the examples of text such as a combination of characters and a logo etc.

At the end of area 304, advantageously, a line or marking 305 is printed. This line 305 is used, as will be described hereinafter in more detail, to help the user to fold the label to define a flag. After line 305 is a second area 306 in which text can be printed. This is the text that will appear on the other side of the label. In preferred embodiments of the present invention, the text that appears on the two sides of the flag is preferably the same. However in alternative embodiments of the invention, the text appearing on the two sides of the flag are different. In alternative embodiments of the invention, text may be provided on one side of the flag only. In that case only one of areas 304 and 306 will contain text.

In order to provide a flag, the length of the leader 302 together with the length of the first area 304 is the same as the length of the second area 306. In one modification, the length of the first area 304 is the same as the length of the second area 306, particularly where the leader is zero. The leader 302, if present, may overlap part of the part 308, which is arranged to be wrapped around the cable or the like. The part 308, which is to be wound around the cable or the like, is next to the second text area 306. The calculation of the length of the area 308 will be described in more detail later.

Finally, next to the part 308 of the cable is a trailer or end margin 310. As with the leader, the trailer 310 can be set by the user, be zero, have a fixed size or be determined automatically by the label printer taking into account any one or more of the criteria listed in respect of the leader margin. In preferred embodiments, the end margin 310 is zero. This is because any minimum distance required between the print head and cutter may be part of area 308.

As mentioned previously, the tape has a first layer to the back of which is applied an adhesive. The adhesive is covered by a backing layer which can be peeled away from the adhesive layer. In alternative embodiments of the present invention, the tape can have a different structure and may for example have three layers, with the additional layer being a lamination layer or may have no adhesive layer.

Figure 6:
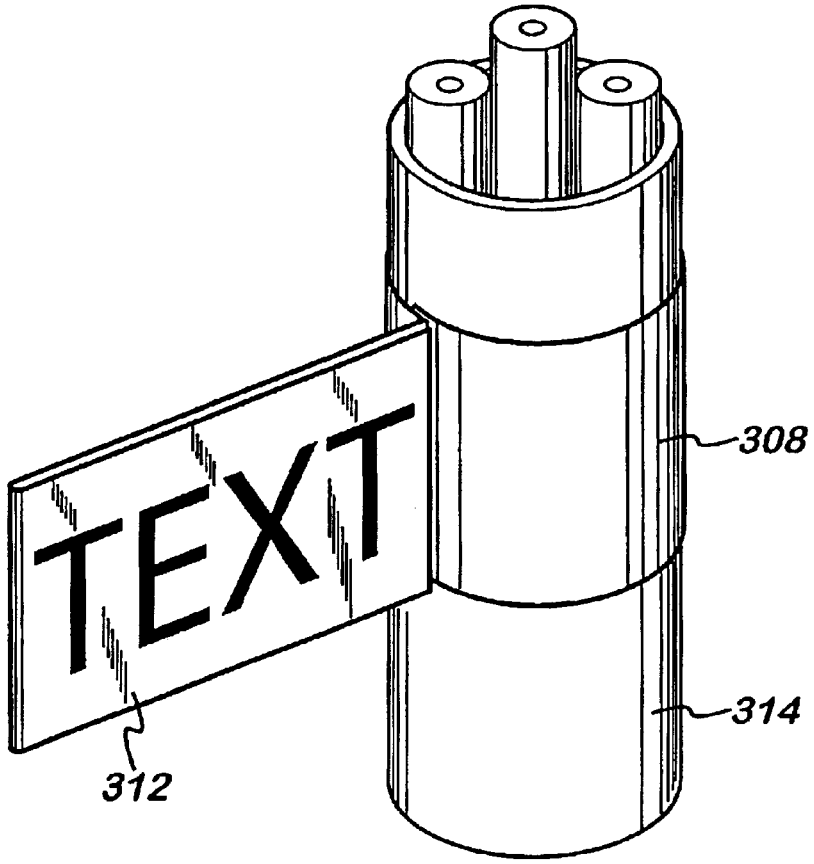
FIG. 6 shows illustratively how the label provides a flag label.
Figure 7:
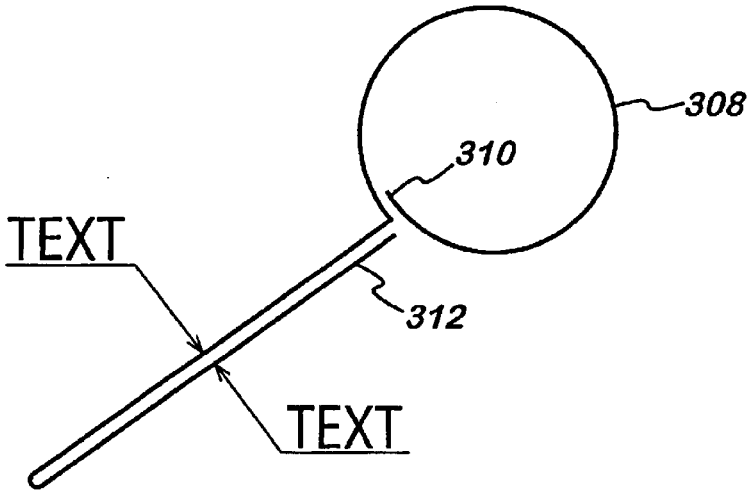
FIG. 7 shows the label of FIG. 5 when applied to a cable.

Reference is made to FIGS. 6 and 7 which show how the label is affixed to a cable or the like. As can be seen, the label is folded along the line 305 and the two parts 304 and 306 containing text are stuck together to form the flag part 312. The flag part 312 can be formed away from the cable location. This means that the user is able to make sure that the two parts 304 and 306 are aligned well so that no adhesive is uncovered. If adhesive is uncovered, this will attract dirt and dust which is undesirable. While the flag part is being formed the winding area 308 and trailer part 310, if present, can be left with the backing layer still attached as this eases the handling of the label. Once the flag part 312 has been formed the winding area 308 and the trailer 310, if present, can be wound around the cable 314 or the like. In preferred embodiments of the present invention, the trailer 310, if present, may be applied first to the cable 314 and then the winding area 308 is wound around the cable. In this way, any overlap of the label around the circumference of the cable will not interfere with the flag part 312. However in alternative embodiments of the present invention, the winding part 308 may be applied first to the cable and then the trailer 310, if present. In this embodiment, if there is any overlap the tape may be wound at an angle around the cable or the overlap may be stuck to the flag. However, in such embodiments, it is preferred that the winding part 308 has a length which is close in size to the circumference of the cable.

As stated, in one embodiment the winding part 308 is greater than the periphery of the support, and the excess 310 is stuck to the flag 312. An operator may choose to stick the excess winding part between the portions of the flag, or the excess winding portion may approximately equal a difference in the length of the folded together portions of the flag 312 such that the adhesive side of the excess winding part 310 is attached to an adhesive side of longer branch of the flag 312.

The length of section 308 can be input by the user or calculated by the tape printer based on information relating to the radius or diameter of the cable or the like input by the user.

Figure 8:
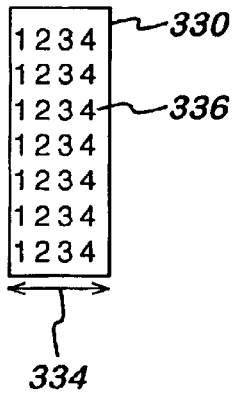
FIG. 8 shows a second label embodying the present invention.
Figure 9:
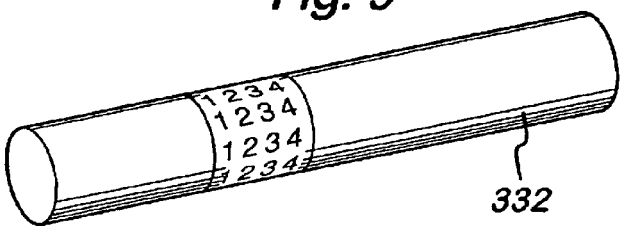
FIG. 9 shows the second label applied to a cable.

Reference is made to FIG. 8 which shows a second label 330 embodying the present invention. This label is arranged to be wound around a cable 332, wire or the like as illustrated in FIG. 9. As can be seen from this FIG. 8, the text is printed across the width 334 of the tape, that is perpendicular to the length of the tape. The text 336 which is entered by the user is repeated n times. The determination of n is based on the length of the label. To determine the length of tape, the user inputs information relating to the size of the cable or the like. This information may be the diameter or the radius of the cable. From this input information, the tape printer is arranged to calculate the circumference of the cable or the like. The circumference information is then used by the tape printer to determine the length of the tape. The length of the tape is related to circumference of the cable. In some embodiments of the invention, the tape has a length which is the same or similar to the circumference. In alternative embodiments of the invention, the length may be greater than the circumference and may for example be 1.5 to 2 times the circumference.

Once the length of the tape has been determined, the value of n is determined. The microprocessor printer may calculate the value of n taking into account the area of the tape within which the image can be printed and taking into account the font size. This can be calculated by the microprocessor or can be obtained from a table stored in memory or the like. The font size may selected by the user, always selected to be the same size or calculated by the tape printer based on the text and/or the width of the tape.

The label when printed is then wound around the cable and the text can be read easily.

It should be appreciated that any of the methods described in relation to the embodiment of FIGS. 8 and 9 for determining length can be used for determining the size of area 308 of the label of FIG. 5.

In the embodiments of the invention described, the label is described as being wound around a cylindrical article. It should be appreciated that the label can be wound around any other support. In this alternative embodiment, the user may have to provide information as the shape of the support so that the correct length of tape can be obtained. The tape printer may have information relating to a number of different shapes stored. The user may be able to scroll down a list or the like to select the appropriate shape. The user then inputs size information of the support. This size information required may be dependent on the shape. Using the size information and the shape information the microprocessor calculates the perimeter, circumference or the like of the support. This value or a multiple of this value is used to determine the length of the label Embodiments of the present invention have been described in the context of a stand alone printer which may optionally be connected to a PC. Some embodiments of the invention may be incorporated in tape printers which are arranged only to work in conjunction with a PC. Such devices may not have a keyboard or the like or a display. In that situation the "input means" referred to in the following claims refers to the input means of the PC or the output received from the PC and the "display means" refers to the display of the PC.

In one modification to the embodiment described, the user may be presented with a number of options via the display. These options correspond to different sizes of cable. The option selected by the user will determine the length of the part of the tape which is used to wrap around the cable or the like. With this modification, length of the part of the tape can be prestored so that when a particular option is selected, the corresponding length information is used, as described in relation to the described embodiments.

It should be appreciated that the wound part 308 can have an image printed thereon.

It should be appreciated that whilst the preferred embodiments of the present invention have been described in the context of tape printers, alternative embodiments of the present invention may be used with other text processing devices or printers.

What is claimed is:

1. A tape printer for printing a flag-type label to be wound around a support comprising:

a supply for providing tape having a printable side and an adhesive side;

a printer adapted to print an image on the tape;

an input device for receiving image data for printing on said tape, a driver to drive a determined portion of tape past the printer;

and a controller for controlling the driver and the printer such that the printer when in a pre-selected flag mode, for producing a flag-type label to be wound around a support, the tape printer is adapted to provide a label having a first area and a second area adjacent to said first area, wherein said first area and said second area are arranged in use to provide a flag portion, said printer being arranged to print an image on at least one of said first and second areas, and to provide on said label a third area arranged on the other side of said second area to the first area, said third area being sized to be attached to a support, wherein one input is an identifier code for the support, and wherein the controller determines the required length of the third area to substantially encompass a periphery of the support.

2. A tape printer for printing a label on a length of tape, said tape printer comprising:

means for receiving a supply of tape;

means for printing an image on said tape;

means for receiving image data for printing on said tape, said tape printer having a flag mode for producing a label to be wound around a support, said tape printer being arranged in said flag mode to provide a label having a first area and a second area adjacent to said first area, said first area and said second area are arranged in use to provide a flag portion, said printing means being arranged to print an image on at least one of said first and second areas, said label further comprising a third area arranged on the other side of said second area to the first area, said third area being sized to be wound around a periphery of said support.

3. The tape printer of claim 2, wherein means are provided for determining the size of the third area.

4. The tape printer of claim 3, wherein said receiving means is arranged to receive information defining the size of said third area.

5. The tape printer of claim 4, wherein said information comprises a diameter or radius of said support.

6. The tape printer of claim 4, wherein said information comprises a circumference of the support.

7. The tape printer of claim 4, wherein third area has a length substantially the same as the periphery of the support to which said label is to be applied.

8. The tape printer of claim 2, wherein said means for receiving image data comprises a keyboard.

9. A tape printer for printing a label to be wound around a support, said tape printer comprising:

means for receiving an image to be printed on said label and information relating to the size of said support;

means for determining the length of the label based on the received information;

means for receiving a supply of tape; and printing means for printing said image on said tape a plurality of times across the width of said tape.

10. The tape printer of claim 9, wherein the number of times that the image is printed on the tape is a predetermined function of the length of the label.

11. The tape printer of claim 9, wherein said label length is a predetermined value between 1 and 2 times a periphery of the support.

12. The tape printer of claim 9, wherein said information relating to the size of said support comprises a diameter or a radius of the support.

13. The tape printer of claim 9, wherein the number of times that the image is printed on the tape is dependent on the width of the tape, the size of the image, or both.

14. A tape printer for printing a label to be wound around a support, said tape printer comprising:

means for receiving an image to be printed on said label and information relating to the size of said support;

means for determining the length of the label based on the received information;

means for receiving a supply of tape; and printing means for printing said image on said tape a plurality of times across the width of said tape, wherein the number of times that the image is printed on the tape is dependent on the width of the tape, the size of the image, or both, and the size of the image is selected by the user, and the length of label is determined by the printer.

15. A tape printer for printing a label comprising:

a supply for providing tape having a printable side and an adhesive side;

a printer adapted to print an image on the tape;

an input device for receiving image data for printing on said tape, a driver to drive a determined portion of tape past the printer;

a controller for controlling the driver and the printer such that the printer when in a pre-selected flag mode, for producing a flag-type label to be wound around a support, the tape printer is adapted to provide a label having a first area and a second area adjacent to said first area, wherein said first area and said second area are arranged in use to provide a flag portion, said printer being arranged to print an image on at least one of said first and second areas, and to provide on said label a third area arranged on the other side of said second area to the first area, said third area being sized to be attached to a support, wherein one input is an identifier code for the support, and wherein the controller determines the required length of the third area to substantially encompass a periphery of the support; and a cutter for cutting the label to the required size determined by the controller.

16. A tape printer for printing a label to be wound around a support, said tape printer comprising:

means for receiving an image to be printed on said label and information relating to the size of said support;

means for determining the length of the label based on the received information;

means for receiving a supply of tape;

printing means for printing said image on said tape a plurality of times across the width of said tape; and means for cutting the label to the length determined based on said information relating to the size of said support.

* * * * *